US005645410A

United States Patent [19]

Brostmeyer

[11] Patent Number: 5,645,410

[45] Date of Patent: Jul. 8, 1997

[54] COMBUSTION CHAMBER WITH MULTI-STAGE COMBUSTION

[75] Inventor: Joseph Brostmeyer, Stockton, N.J.

[73] Assignee: Asea Brown Boveri AG, Baden, Switzerland

[21] Appl. No.: 558,535

[22] Filed: Nov. 16, 1995

[30] Foreign Application Priority Data

Nov. 19, 1994 [DE] Germany ..... 44 41 235.5

[51] Int. Cl.[6] ..... F23C 6/04

[52] U.S. Cl. ..... 431/10; 431/8; 431/351; 431/353

[58] Field of Search ..... 431/10, 8, 350, 431/351, 352, 353; 60/733

[56] References Cited

U.S. PATENT DOCUMENTS 5,158,445 10/1992 Khinkis ..... 431/353

FOREIGN PATENT DOCUMENTS

0433790A1 6/1991 European Pat. Off. .
2937631A1 4/1981 Germany .
3707773A1 9/1988 Germany .
3000672C2 2/1989 Germany .
3149581C2 5/1992 Germany .
682952A5 12/1993 Switzerland .

OTHER PUBLICATIONS

"Etude d'un bruleur bas $NO_x$ pour chaudiere industrielle", Revue Generale de Thermique, No. 330–331, Jun.–Jul. 1989, pp. 379–384.

*Primary Examiner*—Carl D. Price
*Attorney, Agent, or Firm*—Burns, Doane, Swecker & Mathis, L.L.P.

[57] ABSTRACT

In a method of operating a multi-stage combustion chamber, having at least one primary burner (110) of the premixing type of construction, the fuel injected via nozzles is intensively mixed with primary combustion air inside a premixing space in advance of the ignition. Secondary combustion air is directed into a secondary combustion space (62) which is arranged downstream of the precombustion space (61). The primary burner (110) is a flame-stabilizing double-cone burner without a mechanical flame retention baffle, which is operated at the lower stability limit. The burnt gas is accelerated between precombustion space (61) and secondary combustion space (62). For the purpose of forming a self-igniting mixture, cooling air from the double-wall combustion-chamber boundary and additional fuel are introduced into the burnt-gas flow leaving the precombustion space.

3 Claims, 1 Drawing Sheet

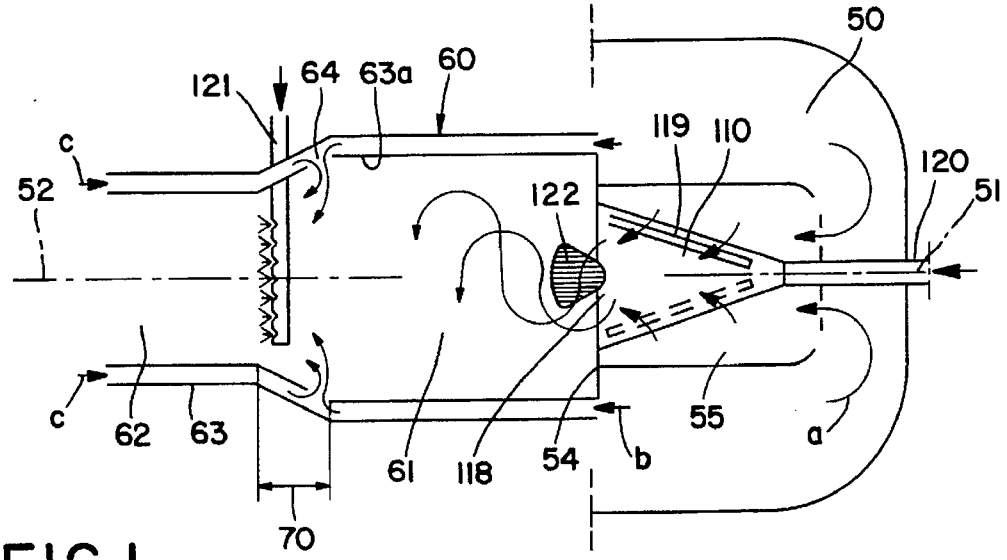
FIG. 1
FIG. 2
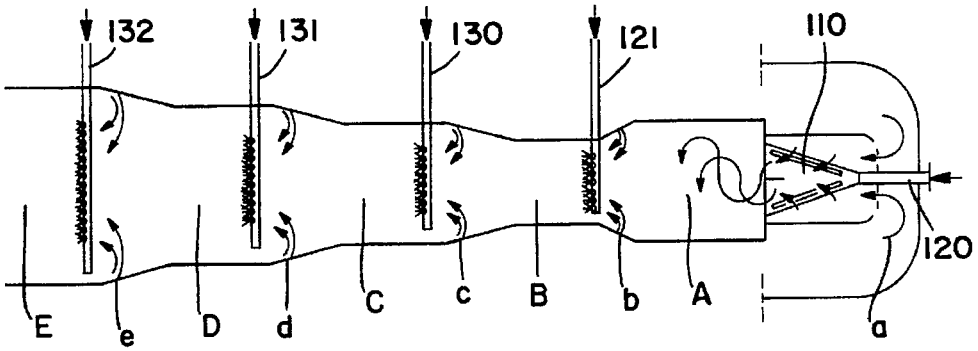
FIG. 3A
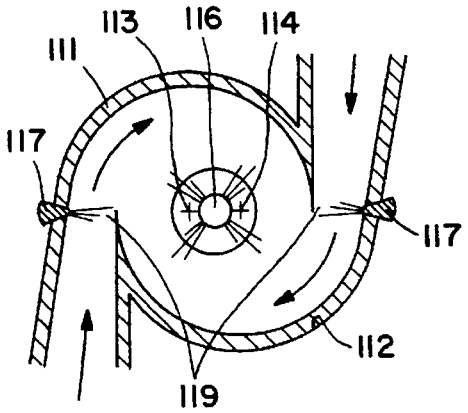
FIG. 3B
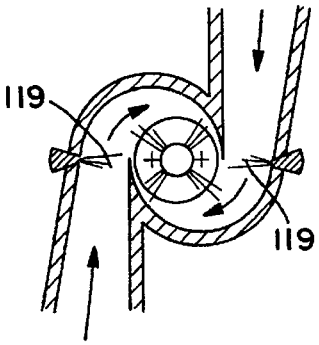

COMBUSTION CHAMBER WITH MULTI-STAGE COMBUSTION

FIELD OF THE INVENTION

The invention relates to a method of operating a multi-stage combustion chamber, having at least one primary burner of the premixing type of construction, in which the fuel injected via nozzles is intensively mixed with primary combustion air inside a premixing space in advance of the ignition, and having at least one secondary combustion space which is arranged downstream of the precombustion space and into which secondary combustion air is directed. It likewise relates to a combustion chamber for carrying out the method.

DISCUSSION OF BACKGROUND

DE-C2 31 49 581 discloses a two-stage combustion chamber and a method of operating it. Swirl bowls having central fuel injection nozzles are used as primary burners of the premixing type of construction. The combustion chamber is a so-called "rich/lean two-stage combustion chamber", the gases in the first combustion stage having a fuel/air equivalent ratio which is greater than 1. In the second combustion stage the gases have a fuel/air equivalent ratio which is less than 1. The transition from the rich to the lean mixture is to be realized as quickly as possible. Therefore the mixture is accelerated, and the secondary combustion air is injected into the accelerated mixture. The purpose of the acceleration is that the retention time of the mixture in the zone in which the fuel/air equivalent ratio is 1 is to be kept as short as possible. This is so, since the speed at which $NO_X$ forms is greatest at these average ratios.

Modern burners of the premixing type of construction offer the possibility of also operating the first combustion stage on a lean mixture, which has an advantageous effect on the $NO_X$ formation on account of the large air coefficient and the low flame temperatures. In such a premixing combustion technique it only has to be ensured that the flame stability, in particular at partial load, does not border on the extinction limit. It is considered to be a rule that such premixing burners, if they are operated in a single-stage manner and if temperatures of 1800 K (about 1530° C.) are demanded, produce about 25–30 ppm $NO_X$.

SUMMARY OF THE INVENTION

Accordingly, one object of the invention, while utilizing such modern premixing burners, it to provide a novel "lean/lean" method and the associated combustion chamber, with which extremely low $NO_X$ emissions are achieved.

According to the invention, this is achieved when

- the primary burner is a flame-stabilizing premixing burner which is operated at the lower stability limit,
- the burnt gas is accelerated between precombustion space and secondary combustion space,
- and, for the purpose of forming a self-igniting mixture, cooling air from the double-wall combustion-chamber boundary and additional fuel are introduced into the burnt-gas flow leaving the precombustion space.

A combustion chamber for carrying out this method is distinguished by a double-cone burner of the premixing type of construction arranged at the head end of the combustion chamber and having an adjoining primary combustion space, by an acceleration section for the burnt gas, which acceleration section follows the primary combustion space and leads into a secondary combustion space, by air inflow openings which are arranged in the area of the acceleration section in the double-wall combustion-chamber boundary, and by injection means for additional fuel which are arranged at the inlet of the secondary combustion space.

DE-A1 37 07 773, in connection with process heat generation, has certainly already disclosed a two-stage method and a corresponding combustion chamber which works with a flame-stabilizing double-cone burner as primary burner, in which the gas is accelerated between precombustion space and secondary combustion space and in which air is added to the second stage. However, as in the prior art already mentioned at the beginning, this precombustion chamber is operated in a sub-stoichiometric way with an air coefficient Lambda=0.7. In this way, the partially burnt gas reaches a temperature of 1800°–1900° C. The air introduced into the accelerated gas flow is so-called quench air which is to be injected rapidly into the main flow in order to avoid oxidation of the atmospheric nitrogen.

The advantage of the invention can be seen in particular in the fact that the premixing burner can be operated at the lower extinction limit, in which case first of all only about 9 ppm $NO_X$ is produced; the self-igniting secondary combustion process delivers gases at the desired high temperature of 1800 K (about 1530° C.), which gases only have $NO_X$ values of less than 6 ppm as a result of the feed of further air and on account of the short retention times.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a partial longitudinal section of a first two-stage combustion chamber;

FIG. 2 shows a partial longitudinal section of a second five-stage combustion chamber;

FIG. 3A shows a cross section through a premixing burner of the double-cone type of construction in the area of its outlet;

FIG. 3B shows a cross section through the same premixing burner in the area of the cone apex.

Only the elements essential for understanding the invention are shown. Not shown are, for example, the complete combustion chamber and how it relates to a system, the provision of fuel, the control equipment and the like. The direction of flow of the working media is designated by arrows.

DESCRIPTION OF THE PREFERRED EMBODIMENTS

Referring now to the drawings, wherein like reference numerals designate identical or corresponding parts throughout the several views, in FIG. 1 an encased plenum is designated by 50, which as a rule receives the combustion air delivered by a compressor (not shown) and feeds it to a, for example annular, combustion chamber 60. This combustion chamber is of two-stage design and essentially consists of a primary combustion chamber 61 and a secondary combustion chamber 62 situated downstream, both of which are encased by a combustion-chamber wall 63. Of all the combustion air, a portion a is fed directly to the precombustion chamber 61, whereas portions b and c initially perform cooling functions.

An annular dome 55 is mounted on the primary combustion chamber 61, which is located at the head end of the combustion chamber 60 and the combustion space of which is defined by a front plate 54. A burner 110 is arranged in this dome in such a way that the burner outlet is at least approximately flush with the front plate 54. The longitudinal axis 51 of the primary burner 110 runs coaxially to the longitudinal axis 52 of the combustion chamber 60. A plurality of such burners 110 are distributed next to one another over the periphery on the annular front plate 54. Via the dome wall perforated at its outer end, the combustion air a flows out of the plenum 50 into the dome interior and acts upon the burner. The fuel is fed to the burner via a fuel lance 120, which passes through the dome wall and the plenum wall.

The premixing burner 110 shown schematically in FIGS. 3A and 3B is in each case a so-called double-cone burner, as disclosed, for example, by U.S. Pat. No. 4,932,861 to Keller et al mentioned at the beginning. It essentially consists of two hollow, conical sectional bodies 111, 112 which are nested one inside the other in the direction of flow.

In this arrangement, the respective center axes 113, 114 of the two sectional bodies are mutually offset. The adjacent walls of the two sectional bodies form slots 119, forming tangential guides, for the combustion air, which in this way passes into the burner interior. A first fuel nozzle 116 for liquid fuel is arranged in the burner interior. The fuel is injected longitudinally at an acute angle into the hollow cone. The resulting conical fuel profile is enclosed by the combustion air flowing in tangentially. The concentration of the fuel is continuously reduced in the axial direction as a result of the mixing with the combustion air. In the case of the example, the burner can likewise be operated with gaseous fuel. To this end, gas inflow openings 117 distributed in the longitudinal direction are provided in the area of tangential slots 119 in the walls of the two sectional bodies. In gas operation, therefore, the mixture formation with the combustion air starts as early as in the zone of the inlet slots 119. It will be understood that mixed operation with both types of fuel is also possible in this way.

At the outlet 118 of the burner 110, as homogeneous a fuel concentration as possible appears over the annular cross section acted upon. A defined calotte-shaped recirculation zone 122, at the tip of which the ignition is effected, develops at the burner outlet. The flame itself is stabilized by the recirculation zone in front of the burner without the need for a mechanical flame retention baffle.

In the case of the example, the premixing burner is operated with about 56% of all the combustion air available, specifically close to the lower extinction limit; i.e. the corresponding fuel quantity is set in such a way that a temperature of 1640 K (about 1370° C.) and an $NO_X$ content of 9 ppm prevail in the primary combustion space 61.

According to FIG. 1, the transition from the primary combustion space 61 to the secondary combustion space 62 forms a restriction which constitutes an acceleration zone 70 for the working medium. In this way, a suitable temperature/velocity zone is to be created for stable self-ignition downstream of fuel lances.

Such fuel lances 121 are arranged at the inlet to the secondary combustion space 62. In the case of an annular combustion chamber, a plurality of such lances are distributed over the periphery. The additional fuel—uniformly distributed over the cross section of flow—is injected from them into the main flow.

Upstream of this fuel injection, the remaining 44% of air is added to the combustion process in a suitable manner. This is the air which is initially used to cool the combustion-chamber walls. These combustion-chamber walls are of double-wall construction in both the area of the primary combustion space 61 and the area of the secondary combustion space 62. The inner wall 63*a* is provided with inlet openings 64 in the plane of the intended air feed. The air quantity, which is added to the main flow, is composed of two partial flows. On the one hand the cooling air b of the primary combustion chamber, which comes to about 16% of the total quantity, and on the other hand the cooling air c of the secondary combustion chamber, which comes to about 28% of the total quantity.

It will be understood that this action is associated with pressure losses. Thus, for example, the pressure loss of the air via the wall cooling is about 4% and that via the mixing of combustion gases and cooling air is about 2%.

The mixing temperature after the admixing of the cooling air to the combustion gases of the primary combustion chamber is about 980° C., so that the fuel/air mixture present at the inlet to the secondary combustion chamber 62 is self-igniting. The quantity of additional fuel is here selected in such a way that the desired end temperature of 1700 K (about 1430° C.) prevails in the secondary combustion space 62. The $NO_X$ content of 9 ppm which has developed during the primary combustion is reduced by the dilution to less than 6 ppm.

It will be understood that the secondary combustion chamber 62 is dimensioned in its axial extent in such a way that complete burn-out takes place therein.

FIG. 2 schematically shows a five-stage combustion chamber, which can be operated as follows:

Fuel is directed to the premixing burner 110 via the fuel lance 120 and is burnt with about 10% of the combustion air a. The fuel quantity fed via the lance 120 is set here in such a way that a temperature of 1640 K (about 1370° C.) and an $NO_X$ content of 9 ppm prevail in the combustion space A. The mixture is accelerated; a further 8% of air, in this case wall-cooling air, is introduced in the plane b and a corresponding quantity of fuel is introduced via the fuel lances 121, so that a temperature of 1500 K (about 1230° C.) prevails in the combustion space B. A further 14% of air is introduced in the plane c and a corresponding quantity of fuel is introduced via the fuel lances 130, so that a temperature of 1500 K (about 1230° C.) likewise prevails in the combustion space C. A further 26% of air is introduced in the plane d and a corresponding quantity of fuel is introduced via the fuel lances 131, so that a temperature of 1500 K (about 1230° C.) also prevails in the combustion space D. The remaining 42% of air is introduced in the plane e and the remaining quantity of fuel is introduced via the fuel lances 132, so that the desired end temperature of 1700 K (about 1430° C.) prevails in the combustion space E. By the successive reduction of the $NO_X$ which has developed during the precombustion, it is perfectly possible for an $NO_X$ content of only 3 ppm to be present in the combustion space E.

In effect it can be stated that the optimum number of combustion stages with regard to the $NO_X$ value to be achieved is to be selected as a function of the pressure loss to be tolerated and the length of the combustion chamber.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A method of operating a multi-stage combustion chamber having at least one primary flame-stabilizing premixing burner in which fuel injected via nozzles is intensively mixed with primary combustion air inside a premixing space before ignition, and having a primary combustion space and at least one secondary combustion space downstream of the primary combustion space, the combustion chamber having a double-wall enclosure defining a cooling air duct between an inner and an outer wall, the method comprising the steps of:

operating the primary burner at a lower stability limit to combust a fuel and air mixture in the primary space to produce a combustion gas flow, introducing air from the cooling air duct into the combustion gas flow leaving the primary combustion space, accelerating the combustion gas flow and introduced air into the secondary combustion space, and introducing additional fuel into the combustion gas flow at an inlet to the secondary combustion space, wherein a self-igniting mixture of fuel and combustion air is formed for combustion in the secondary space.

2. A combustion chamber for multi-stage combustion, comprising:

a double-walled enclosure, an inner wall defining a primary combustion space and at least one secondary combustion space, the inner wall and an outer wall defining therebetween a cooling duct, a premixing burner mounted at a head end of the primary combustion space, an acceleration section between an outlet of the primary combustion space and an inlet of the at least one secondary combustion space, the inner wall of the enclosure having inflow openings to guide air from the cooling air duct into an inlet end of the acceleration section, and, means for injecting additional fuel at the inlet end of the at least one secondary combustion space.

3. The combustion chamber as claimed in claim 2, wherein the premixing burner comprises a double-cone burner having two half-cone section bodies mounted to form a conical interior, longitudinal axes of the bodies being offset so that adjacent edges of the bodies define longitudinal slots for a tangentially directed flow of air into the interior space, and means for injecting a fuel into the interior space, ignition of a fuel and air mixture forming a stable flame front at an outlet of the burner without a mechanical flame retention baffle.

* * * * *